US007407466B2

(12) United States Patent
Chiu

(10) Patent No.: US 7,407,466 B2
(45) Date of Patent: Aug. 5, 2008

(54) REAR WHEEL AXLE SUPPORT ASSEMBLY FOR A FITNESS BICYCLE

(75) Inventor: Juei-Tsung Chiu, Minhsiung Hsiang (TW)

(73) Assignee: Fitness Products Inc., Chiayi Hsien (TW)

( * ) Notice: Subject to any disclaimer, the term of this patent is extended or adjusted under 35 U.S.C. 154(b) by 712 days.

(21) Appl. No.: 11/030,645

(22) Filed: Jan. 4, 2005

(65) Prior Publication Data

US 2006/0144804 A1 Jul. 6, 2006

(51) Int. Cl.
*A63B 69/16* (2006.01)

(52) U.S. Cl. ..... 482/61; 482/57

(58) Field of Classification Search ..... 482/51, 482/54, 57, 61, 148, 908; 434/61; 464/38
See application file for complete search history.

(56) References Cited

U.S. PATENT DOCUMENTS 5,152,729 A * 10/1992 Phillips ..... 482/61
5,728,029 A * 3/1998 Minoura ..... 482/61
5,800,316 A * 9/1998 Huang ..... 482/61
6,702,721 B2 * 3/2004 Schroeder ..... 482/61
6,736,761 B2 * 5/2004 Huang ..... 482/57
6,780,143 B2 * 8/2004 Copeland ..... 482/61

* cited by examiner

*Primary Examiner*—LoAn H. Thanh
*Assistant Examiner*—Tam Nguyen
(74) *Attorney, Agent, or Firm*—Alan Kamrath; Kamrath & Associates PA

(57) ABSTRACT

A rear wheel axle support assembly for a fitness bicycle includes: a front rack, a rear rack, and two retaining portions, on an upper portion of a left and a right rods of the front rack provided two coupling seats for connecting the left and the right rods of the rear rack, so that the front rack and the rear rack are connected in a herringbone pattern, the two retaining portions disposed at an upper end of the left and the right rods of the front rack for clamping both ends of a rear wheel axle of a fitness bicycle. The rear wheel axle support assembly is capable of clamping and unclamping the rear wheel axle of a fitness bicycle by using retaining portions.

1 Claim, 6 Drawing Sheets

REAR WHEEL AXLE SUPPORT ASSEMBLY FOR A FITNESS BICYCLE

BACKGROUND OF THE INVENTION

1. Field of the Invention

The present invention relates to a support assembly, and more particularly to a rear wheel axle support assembly for a fitness bicycle capable of clamping and unclamping the rear wheel axle of a fitness bicycle by using retaining portions.

2. Description of the Prior Arts

A conventional rear wheel axle support assembly as shown in FIG. 1 comprises a U-shaped front rack 1, a U-shaped rear rack 2, and two retaining portions 3 and 4. On the upper portion of the left and the right rods 11, 12 of the front rack 1 are provided two coupling seats 13 for connecting the left and the right rods 21, 22 of the rear rack 2, so that the front rack 1 and the rear rack 2 are connected in a herringbone pattern. The retaining portions 3 and 4 are disposed at the end of the left and the right rods 11, 12 of the front rack 1 for clamping both ends of the rear wheel axle 51 of a fitness bicycle.

Referring to FIG. 2, the retaining portion 3 comprises an outer cylinder 31, an inner cylinder 32 and a retaining rod 33. The inner cylinder 32 is disposed in the outer cylinder 31 and is provided with an inner threaded hole 321 for screwing with a threaded section 331 on the retaining rod 33. At both ends of the retaining rod 33 are arranged a retaining sleeve 332 and an adjusting ring 333. Furthermore, a locking ring 334 is screwed on the threaded section 331 and located between the adjusting ring 333 and the outer cylinder 31. The retaining portion 4 is structurally the same as the retaining portion 3, so further explanations will be omitted.

As mentioned above, the retaining portions 3 and 4 are used to clamping both ends of the rear wheel axle 51, and by rotating the adjusting ring 333, the retaining ring 332 will rotate clockwise or counterclockwise relative to the outer cylinder 31, so as to clamp or to unclamp the rear wheel axle 51.

Therefore, it is inconvenient and time-consuming for the user to clamp or unclamp the rear wheel axle 51 by rotating the rotating ring 333 of the retaining portion 3.

The present invention has arisen to mitigate and/or obviate the afore-described disadvantages.

SUMMARY OF THE INVENTION

The primary objective of the present invention is to provide a rear wheel axle support assembly for a fitness bicycle capable of clamping and unclamping the rear wheel axle of a fitness bicycle by using retaining portions.

A rear wheel axle support assembly provided in accordance with the present invention comprises: a front rack, a rear rack, and two retaining portions, on an upper portion of a left and a right rods of the front rack provided two coupling seats for connecting the left and the right rods of the rear rack, so that the front rack and the rear rack being connected in a herringbone pattern, the two retaining portions disposed at an upper end of the left and the right rods of the front rack for clamping both ends of a rear wheel axle of a fitness bicycle.

The retaining portion comprises an outer cylinder, a mid cylinder, an inner cylinder, a retaining rod and a locking block. The outer cylinder is a hollow structure transversely arranged at a top end of the left rod of the front rack, at a center of a top portion of the outer cylinder is formed a rectangular through hole for receiving the locking block, and bellow a long side of the rectangular through hole is an aperture provided for insertion of a pin. The mid cylinder is a hollow structure having an inner space, on an inner surface of the inner space are oppositely formed a pair of sliding ribs, at a bottom surface of the inner space is formed a receiving groove for receiving a tension spring, and adjacent to a front end of the receiving groove is a hooking aperture for positioning a front end of the tension spring, a through hole is formed at a center of a top portion of the mid cylinder correspondingly to the rectangular through hole of the outer cylinder, and bellow a long side of the trough hole of the mid cylinder is a pin-insertion aperture provided for insertion of a pin, a cavity is connected to a front end of the through hole of the mid cylinder and in the cavity is disposed a spring-retaining portion. The inner cylinder is a hollow structure disposed in the inner space of the mid cylinder, on an outer surface of the inner cylinder are oppositely formed a pair of sliding grooves for engaging with the sliding ribs, at a bottom surface of the inner cylinder is formed a receiving groove for receiving the tension spring, at a top surface of the inner cylinder is formed an elongated groove, and on the top surface of the inner cylinder and adjacent to a front end of the elongated groove is formed a rod-inserting hole. The adjusting member is fixed to a front end of the retaining rod by a screw, the retaining rod is inserted through the inner cylinder, on an outer surface of the retaining rod is formed a plurality of locking grooves, and a rear end of the retaining rod is locked with a retaining ring. The locking block is defined at the center thereof with a pin-inserting hole for insertion of the pin, at a bottom surface of an upper portion of the locking block is formed a spring-retaining portion for retaining an upper end of a compression spring, and on the bottom surface of a lower portion of the locking block are provided a plurality of teeth for meshing with the locking grooves.

The present invention will become more obvious from the following description when taken in connection with the accompanying drawings, which show, for purpose of illustrations only, a preferred embodiment in accordance with the present invention.

DETAILED DESCRIPTION OF THE PREFERRED EMBODIMENT

Figure 1:
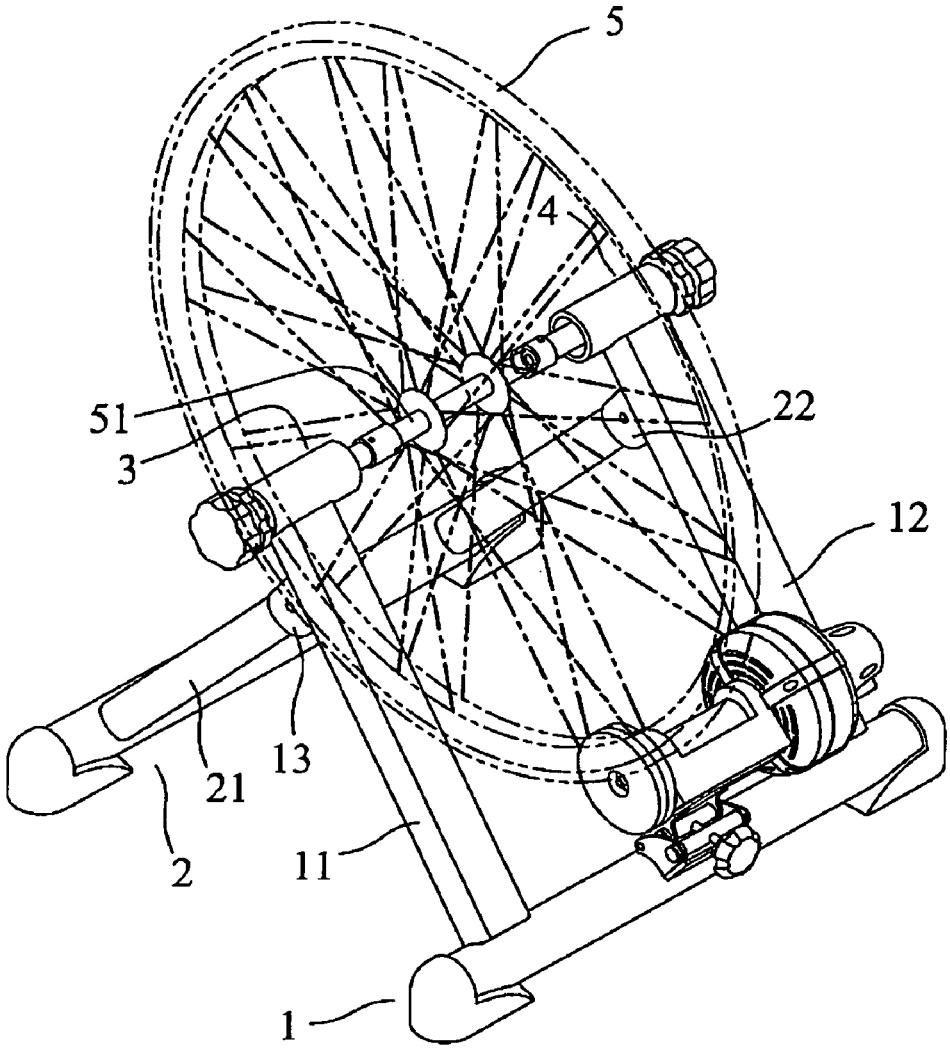
FIG.1 PRIOR ART
FIG. 1 shows a conventional rear wheel axle support assembly for a fitness bicycle.
Figure 2:
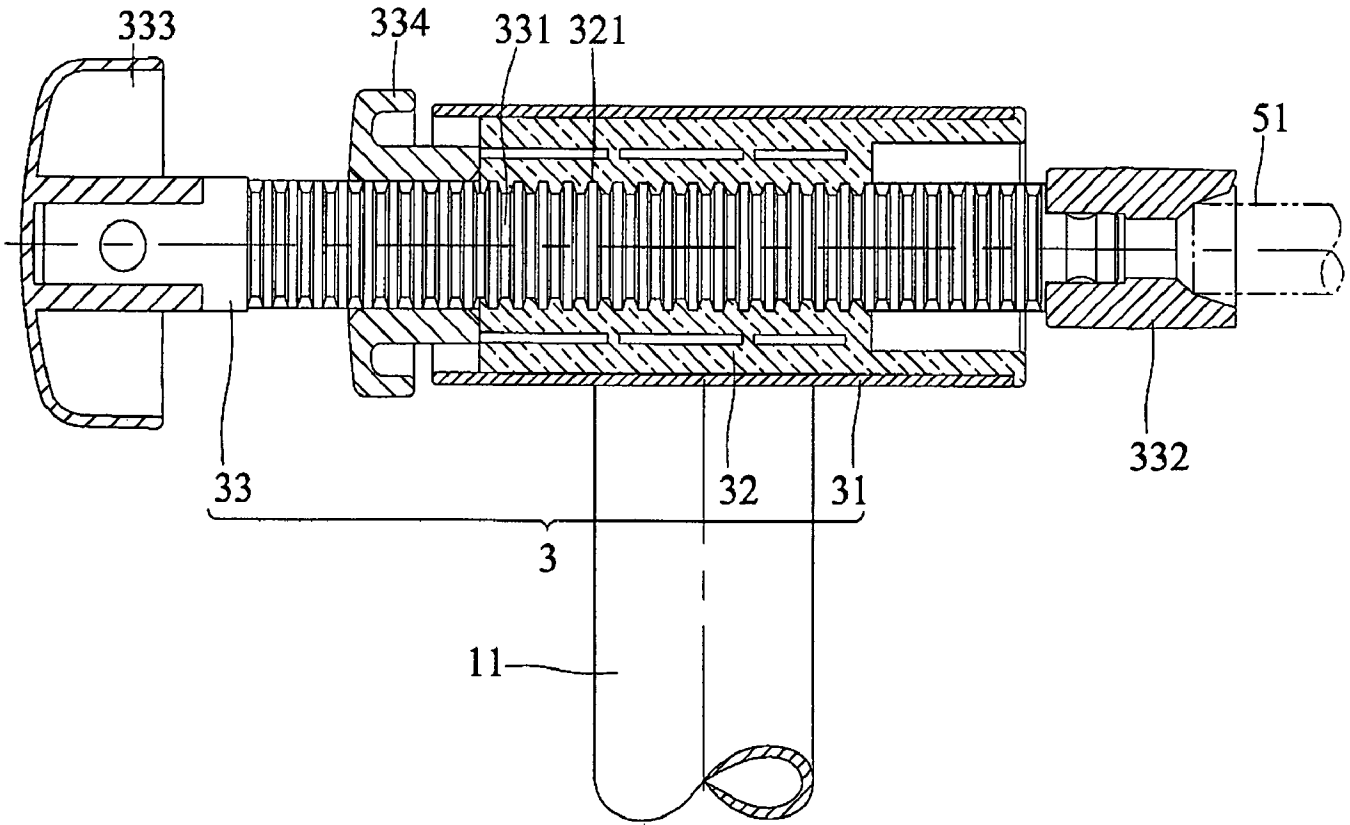
FIG.2 PRIOR ART
FIG. 2 is a cross sectional view the conventional rear wheel axle support assembly for a fitness bicycle in FIG. 1.
Figure 3:
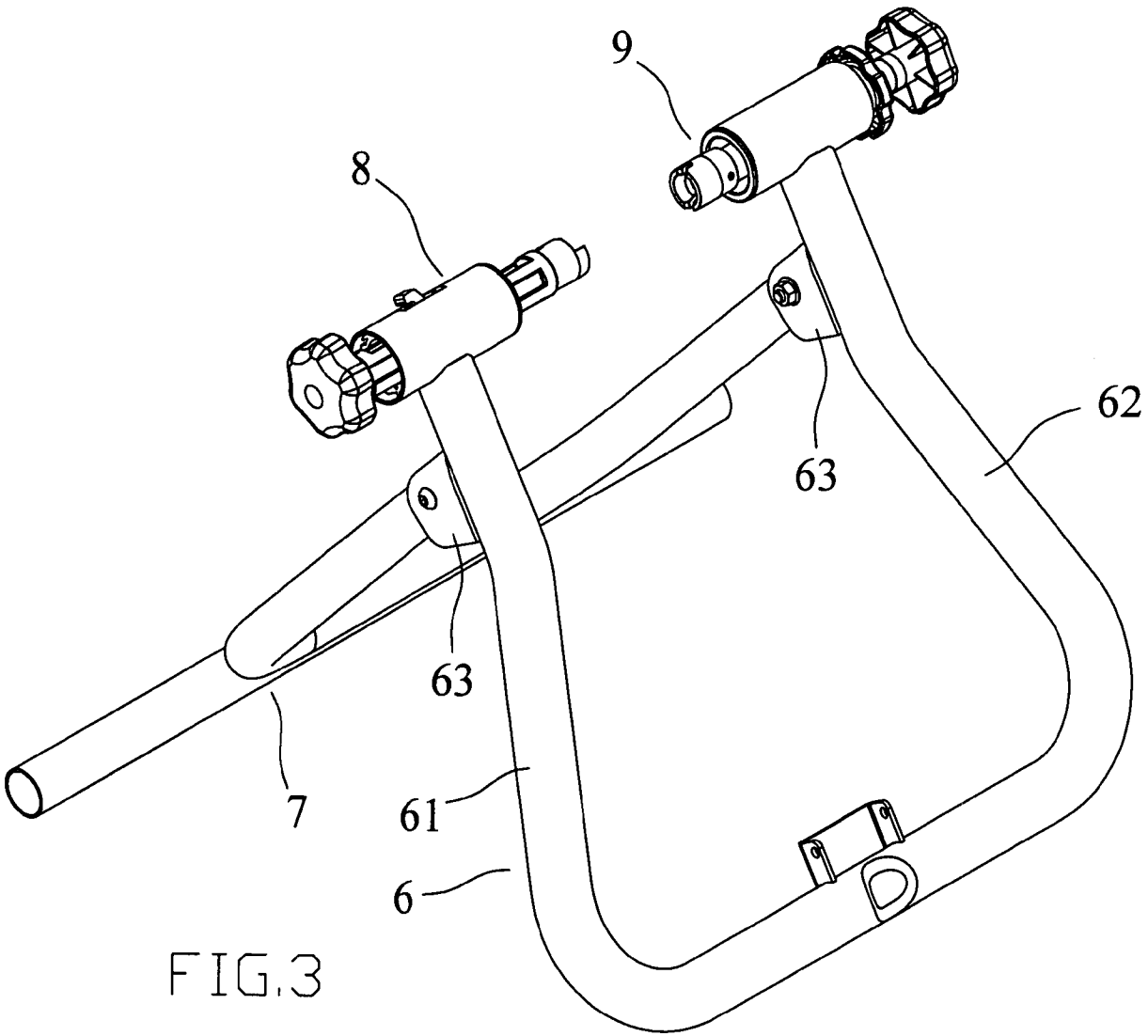
FIG. 3 shows a rear wheel axle support assembly for a fitness bicycle in accordance with the present invention.

Referring to FIG. 3, a rear wheel axle support assembly for a fitness bicycle in accordance with the present invention is shown and comprises: a front rack 6, a rear rack 7, and two retaining portions 8, 9. On an upper portion of the left and the right rods 61, 62 of the front rack 6 are provided two coupling seats 63 for connecting the front rack to the left and the right rods 71, 72 of the rear rack 7, so that the front rack 6 and the rear rack 7 are connected in a herringbone pattern. The retaining portions 8 and 9 are disposed at an upper end of the left and the right rods 61, 62 of the front rack 6 for clamping both ends of the rear wheel axle of a fitness bicycle.

Figure 4:
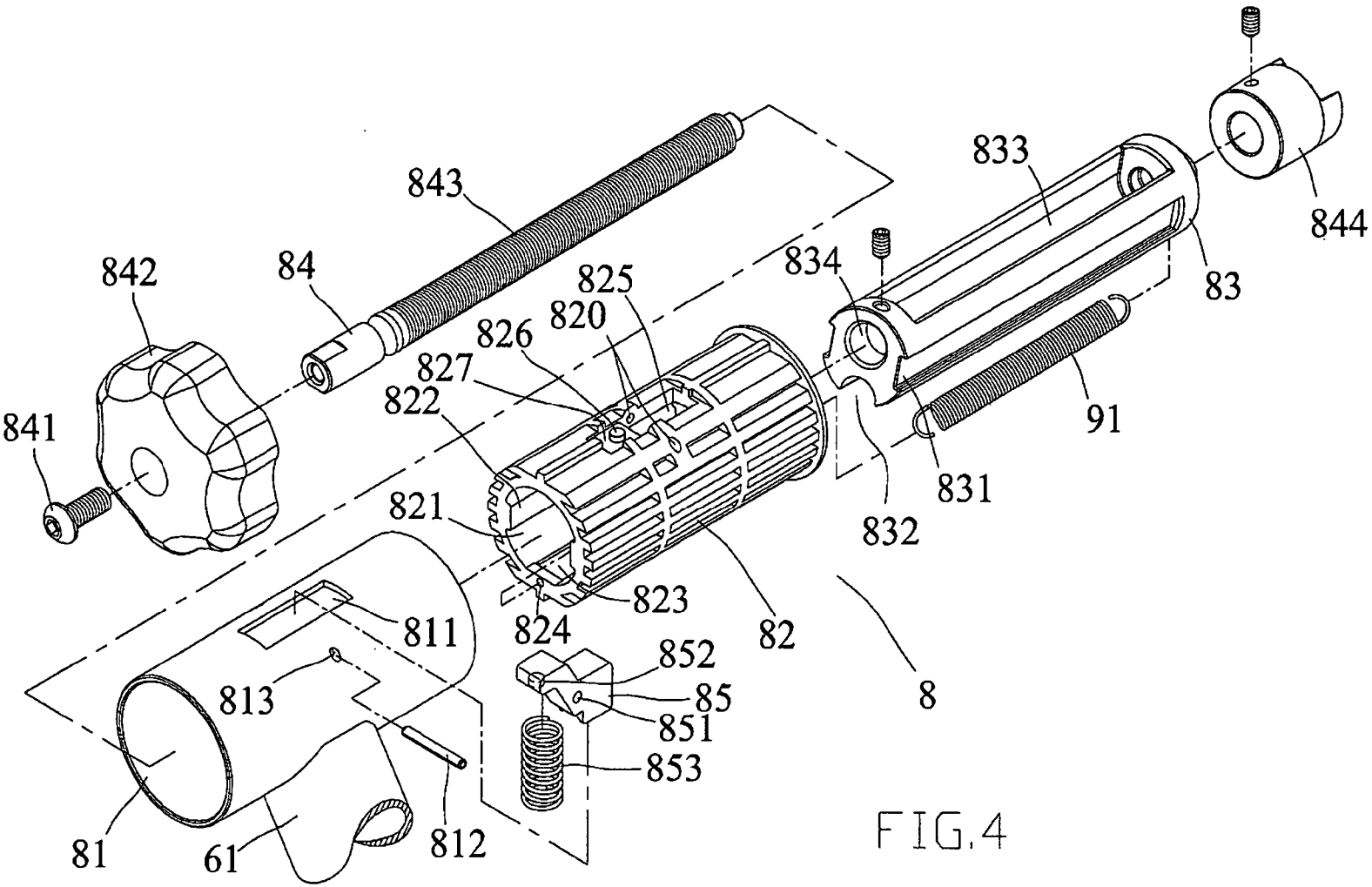
FIG. 4 is an exploded view of a retaining portion of the rear wheel axle support assembly for a fitness bicycle in accordance with the present invention.

The retaining portion 8 comprises an outer cylinder 81, a mid cylinder 82, an inner cylinder 83, a retaining rod 84 and a locking block 85, as shown in FIG. 4.

The outer cylinder 81 is a hollow member transversely arranged at the top end of the left rod 61, at the center of the top portion of outer cylinder 81 is formed a rectangular through hole 811 for receiving the locking block 85, and formed below the long side of the through hole 811 is an aperture 813 provided for insertion of a pin 812.

The mid cylinder 82 is a hollow member having an inner space 821, on the inner surface of the inner space 821 are oppositely formed a pair of sliding ribs 822, at the bottom surface of the inner space 821 is formed a receiving groove 823 for receiving a tension spring 91, and adjacent to a front end of the receiving groove 823 is a hooking aperture 824 for positioning an end of the tension spring 91. A through hole 825 is formed at the center of the top portion of the mid cylinder 82 correspondingly to the through hole 811 of the outer cylinder 82, and formed below the long side of the through hole 825 is an pin-insertion aperture 820 provided for insertion of a pin 812. A cavity 827 is connected to a front end of the through hole 825 and deposed in the cavity 827 is spring-retaining portion 826.

The inner cylinder 83 is a hollow structure disposed in the inner space 821 of the mid cylinder 82, on the outer surface of the inner cylinder 83 are oppositely formed a pair of sliding grooves 831 for engaging with the sliding ribs 822, at the bottom surface of the inner cylinder 83 is formed a receiving groove 832 for receiving the tension spring 91, at the top surface of the inner cylinder 83 is formed an elongated groove 833, and on the top surface of the inner cylinder 83 adjacent to a front end of the elongated groove 833 is formed a rod-inserting hole 834.

An adjusting member 842 is fixed to a front end of the retaining rod 84 by a screw 841, the retaining rod 84 is inserted through the inner cylinder 83, on the outer surface of the retaining rod 84 is formed a plurality of locking grooves 843, and the rear end of the retaining rod 84 is locked with a retaining ring 844.

Figure 5:
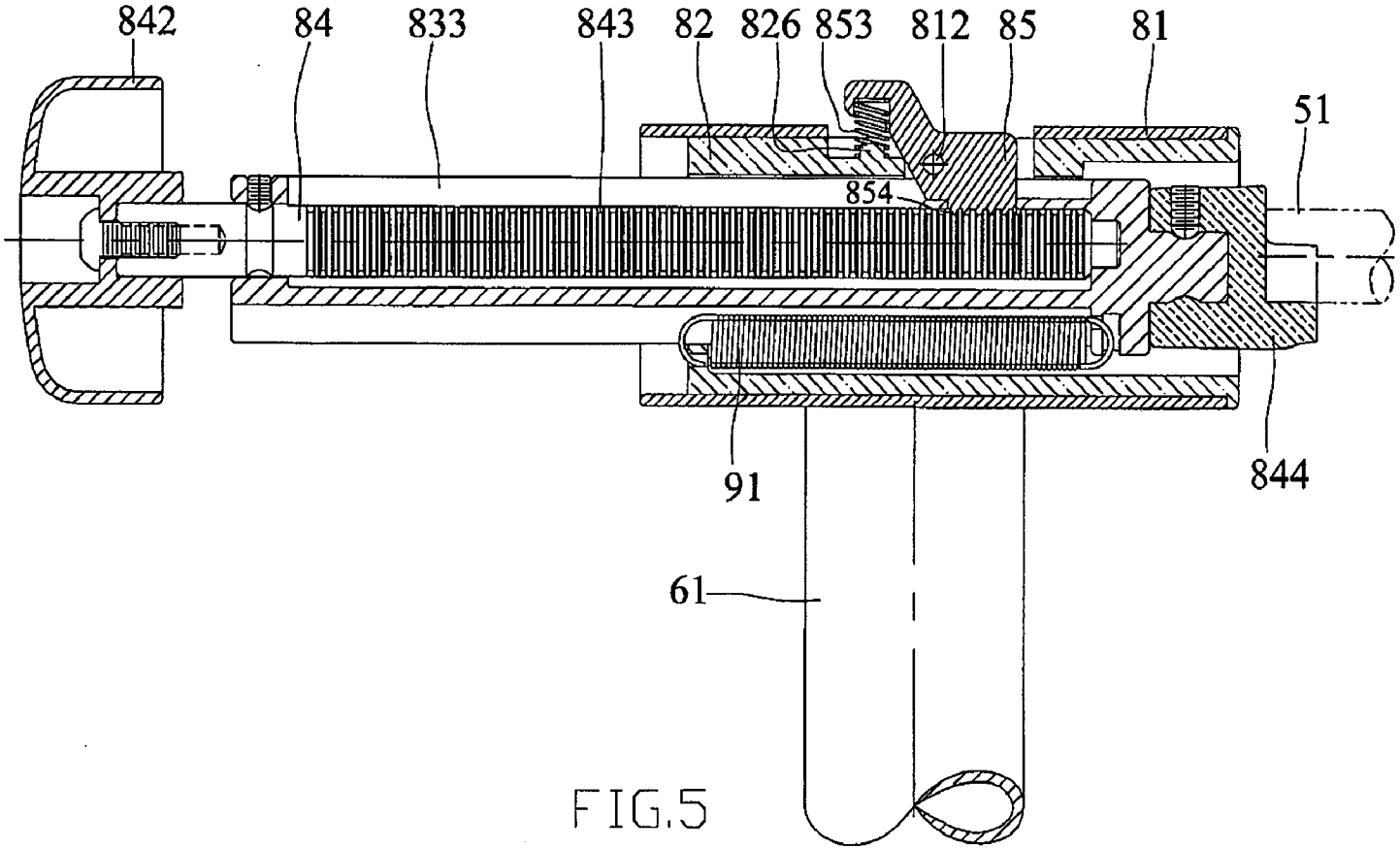
FIG. 5 is an assembly cross sectional view retaining portion of the rear wheel axle support assembly for a fitness bicycle in accordance with the present invention.

The locking block 85 is defined at the center with a pin-inserting hole 851 for insertion of the pin 812, at the bottom surface of an upper portion of the locking block 85 is formed a spring-retaining portion 852 for retaining an upper end of a compression spring 853, and on the bottom surface of a lower portion of the locking block 85 are provided a plurality of teeth 854 for meshing with the locking grooves 843, as shown in FIG. 5. The retaining portion 9 is completely the same as the retaining portion 8, so further explanations will be omitted.

Figure 6:
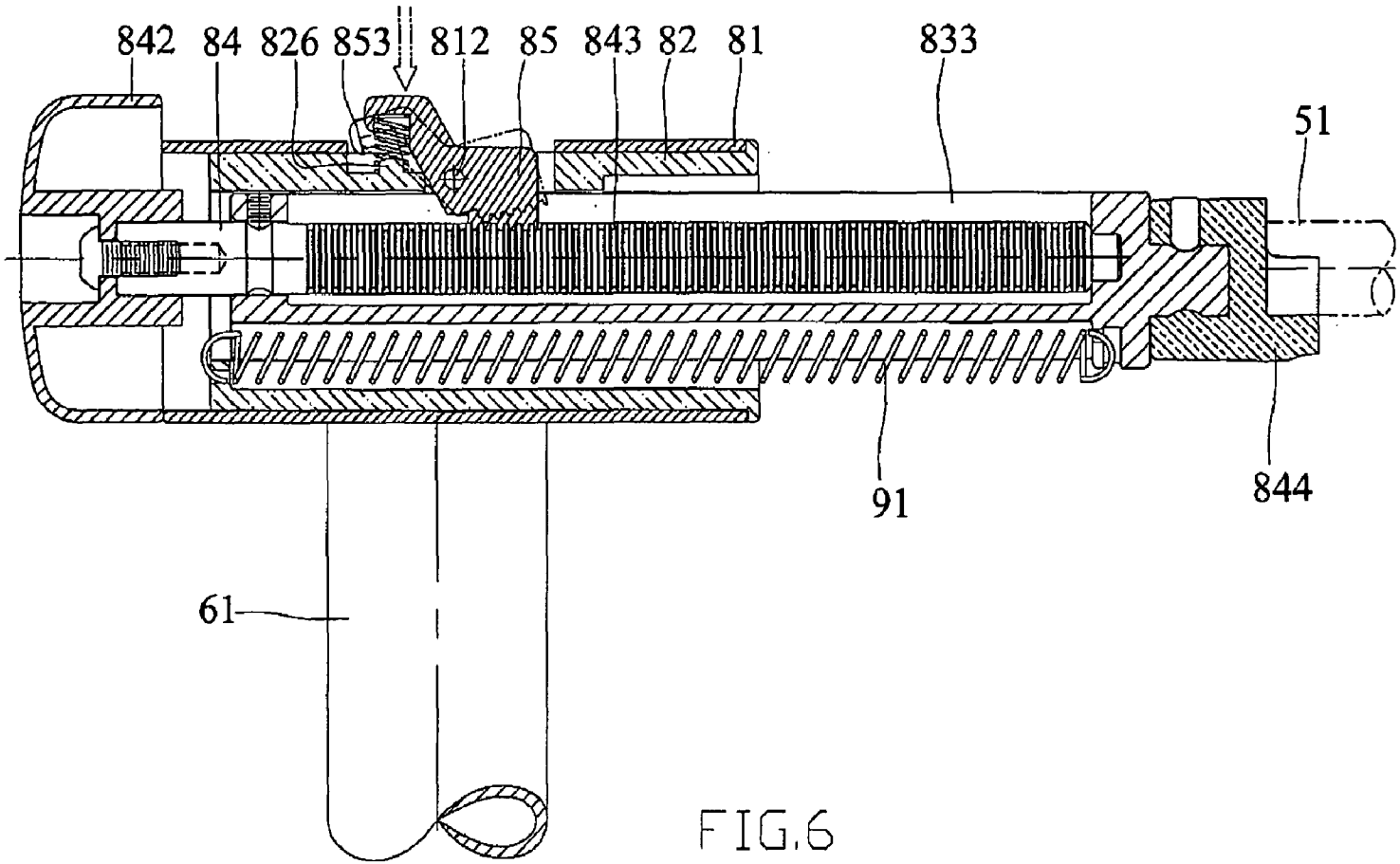
FIG. 6 is an operational view retaining portion of the rear wheel axle support assembly for a fitness bicycle in accordance with the present invention.

Referring to FIG. 6, if the user presses the upper portion of the locking block 85, the teeth 854 on the lower portion of the locking block 85 will be disengaged from the locking grooves 843. And then, the user can adjust a distance between the retaining ring 844 on the retaining rod 84 and the rear wheel axle 51 by horizontally moving the retaining rod 84. When the distance between the retaining ring 844 on the retaining rod 84 and the rear wheel axle 51 is adjusted to a desired value, the user can stop pressing the upper portion of the locking block 85, then the teeth 854 on the lower portion of the locking block 85 will engage the locking grooves 843 automatically under the effect of the compression spring 853. Through this way, the retaining portions 8, 9 can clamp and unclamp the rear wheel axle 51 easily and quickly.

When the retaining ring 844 engages an end of the rear wheel axle 51, the user can rotate the adjusting ring 842 to micro move the retaining rod 84, so as to intensify the engagement between the retaining ring 844 and the rear wheel axle 51.

The retaining rod 84 is integrally connected with the inner cylinder 83, the retaining ring 844 and the adjusting ring 842. When the retaining rod 84 moves in an opposite direction to the rear wheel axle 51, the tension spring 91 will be extended, and vice versa, when the retaining rod 84 moves toward the rear wheel axle 51, the tension spring 91 will be compressed.

The retaining rod 84 can be fixed after the teeth 854 on the lower portion of the locking block 85 engage the locking grooves 843 of the retaining rod 84, and retaining rod 84 can be moved away from the rear wheel axle 51 after the teeth 854 on the lower portion of the locking block 85 disengage the locking grooves 843 of the retaining rod 84. Through this way, the retaining ring 844 can unclamp the rear wheel axle 51 easily and quickly.

While we have shown and described various embodiments in accordance with the present invention, it should be clear to those skilled in the art that further embodiments may be made without departing from the scope of the present invention.

What is claimed is:

1. A rear wheel axle support assembly for a fitness bicycle, the axle support assembly comprising:

a substantially U-shaped front rack and a substantially U-shaped rear rack, each having right and left rods;

two retaining portions disposed at the top ends of the front rack;

a coupling seat disposed on an upper portion of the rear rack for connecting the left and right rods of the rear rack to the left and right rods of the front rod so that the front and rear racks are configured in a herringbone pattern wherein the two retaining portions are adapted for clamping both ends of a rear wheel of a fitness bicycle; and wherein the retaining portion comprises an outer cylinder, a mid cylinder, an inner cylinder, a retaining rod and a locking block;

the outer cylinder is a hollow structure transversely arranged at a top end of the left rod of the front rack, at a center of a top portion of the outer cylinder is formed a rectangular through hole for receiving the locking block, and below along side of the rectangular through hole is an aperture provided for insertion of a pin;

the mid cylinder is a hollow structure having an inner space, on an inner surface of the inner space are oppositely formed a pair of sliding ribs, at a bottom surface of the inner space is formed a receiving groove for receiving a tension spring, and adjacent to a front end of the receiving groove is a hooking aperture for positioning a front end of the tension spring, a through hole is formed at a center of a top portion of the mid cylinder correspondingly to the rectangular through hole of the outer cylinder, and below along side of the through hole of the mid cylinder is a pin-insertion aperture provided for insertion of the pin, a cavity is connected to a front end of the through hole of the mid cylinder and in the cavity is disposed a spring-retaining portion;

the inner cylinder is a hollow structure disposed in the inner space of the mid cylinder, on an outer surface of the inner cylinder are oppositely formed a pair of sliding grooves for engaging with the sliding ribs, at a bottom surface of the inner cylinder is formed a receiving groove for receiving the tension spring, at a top surface of the inner cylinder is formed an elongated groove, and on the top surface of the inner cylinder and adjacent to a front end of the elongated groove is formed a rod-inserting hole;

an adjusting member is fixed to a front end of the retaining rod by a screw, the retaining rod is inserted through the inner cylinder, on an outer surface of the retaining rod is formed a plurality of locking grooves, and a rear end of the retaining rod is locked with a retaining ring;

the locking block is defined at the center thereof with a pin-inserting hole for insertion of the pin, at a bottom surface of an upper portion of the locking block is formed a spring-retaining portion for retaining an upper end of a compression spring, and on the bottom surface of a lower portion of the locking block are provided a plurality of teeth for meshing with the locking grooves;

by pressing an upper portion of the locking block, the teeth on a lower portion of the locking block will be disengaged from the locking grooves, after that, a distance between the retaining ring on the retaining rod and the rear wheel axle will be adjusted by horizontally moving the retaining rod, when the distance between the retaining ring on the retaining rod 84 the rear wheel axle is adjusted to a desired value, the user can stop pressing the upper portion of the locking block, then the teeth on the lower portion of the locking block will engage the locking grooves automatically under the effect of the compression spring, through this way, the two retaining portions can clamp and unclamp the rear wheel axle easily and quickly.

* * * * *